United States Patent [19]

Gillen et al.

[11] Patent Number: 4,930,235

[45] Date of Patent: Jun. 5, 1990

[54] PHONE NUMBER DISPLAY DEVICE

[76] Inventors: Wendy N. Gillen, 246 Glenwood Ave., Glen Ellyn, Ill. 60137; Laurie N. Gavin, 0S 048 Pleasant Hill Rd., Wheaton, Ill. 60187; Jean C. Neubauer, 303 N. Main St., Mount Prospect, Ill. 60056

[21] Appl. No.: 151,075

[22] Filed: Feb. 1, 1988

[51] Int. Cl.[5] ..... G09F 1/12

[52] U.S. Cl. ..... 40/152; 40/661

[58] Field of Search ..... 40/642, 611, 661, 152, 40/158.1, 159, 152.1, 336, 330, 594, 595, 626

[56] References Cited

U.S. PATENT DOCUMENTS

| | | | |
|---|---|---|---|
| 1,830,690 | 11/1931 | Philibert | 40/595 |
| 2,003,824 | 6/1935 | Cavalero | 40/152.1 |
| 2,049,165 | 7/1936 | Kellermeier | 40/152.1 |
| 3,703,045 | 11/1972 | Nyman | 40/152 |
| 4,190,691 | 2/1980 | Kramer | 40/158.1 |

OTHER PUBLICATIONS

Ann Landers Column, *The Washington Post,* Jan. 25, 1988.

*Primary Examiner*—Cary E. Stone
*Attorney, Agent, or Firm*—Douglas B. White

[57] ABSTRACT

There is provided a simplified phone number reference device for use by children and which does not require general reading ability. The device is a multi-sided structure of clear side walls having an internal support for displaying photographs of scenes or people recognizable to the children. The device includes a phone number display mounting proximate the pictures which associates the phone number with the recognized scene or person in the photograph.

4 Claims, 2 Drawing Sheets

PHONE NUMBER DISPLAY DEVICE

BACKGROUND OF THE INVENTION

1. Field of the Invention

The present invention relates generally to display devices, but more particularly to devices for the display of phone numbers to provide ready access in the case of emergency, especially for children.

2. Description of the Prior Art

Phone number references devices in the prior art have generally been directed toward the adult user. Phone books or displayed lists of phone numbers require the user to access the information and be capable of reading the information associated with the phone number, to choose the number, and then to dial the phone number. While young children can be taught to recognize and dial numbers, it is difficult for them to find or look-up a number, particularly in an emergency. No prior art device is available to simplify this task for the child.

In recent years some development has been made in the art of photograph display devices. In the U.S. Pat. No. 3,703,045 issued to Nyman in 1972, there is shown a clear cube structure for displaying photographs on the side walls thereof Similarly, in U.S. Pat. No. 3,774,332 issued to Schneider, a modified cube structure is also provided to display photographs on the side walls. While these photograph display devices represent interesting improvements in the field of photograph display, no similar advancement has been suggested in the art for improving phone number reference devices.

SUMMARY OF THE INVENTION

It is accordingly an object of the present invention to provide a simplified phone number reference device for use by children and which does not require general reading ability It is a further object of the invention to provide a phone number reference device which is attractive and decorative, but highly effective for use by children.

Generally there is provided a multi-sided structure of clear side walls having an internal support for displaying photographs or drawings of scenes or people recognizable to the children. There is further provided within the structure a phone number display mounting which associates the phone number with the recognized scene or person in the photograph. In one version of the device, one side of the structure may be selectively removable to allow insertion of an internal support bearing the pictorial information. Phone number display is provided in one embodiment on either the internal support on the picture and arranged to be readable through the clear side. In a second embodiment, the phone number is mounted to the exterior of the device and is changeable without accessing the internal portion of the device.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 1:
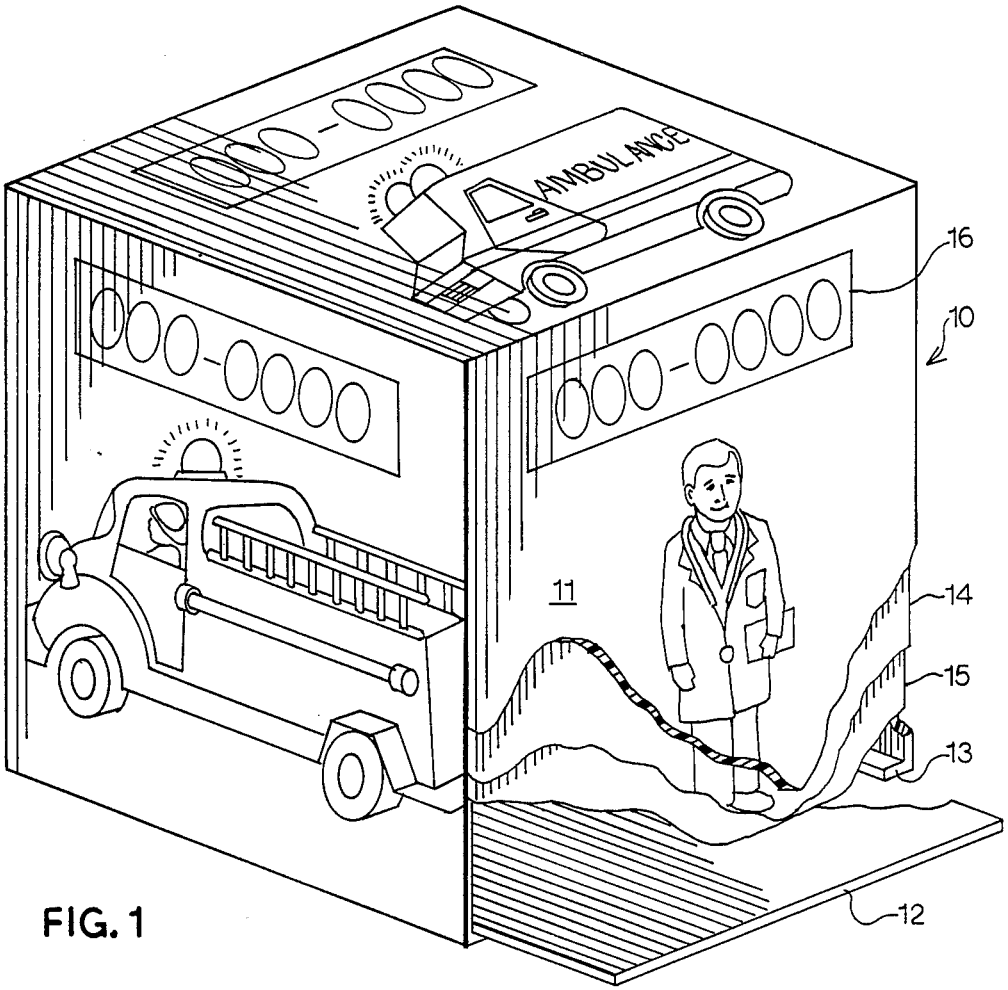
FIG. 1 is a pictorial view of a first embodiment of the present invention showing the multi-sided structure bearing pictures mounted therein and bearing a phone number display mounted in proximity to the picture.

Turning first to FIG. 1 there is shown a phone number display device 10 in accordance with the present invention. This device is generally comprised of a multi-sided structure such as a cube composed of clear plastic side walls 11. In the six sided version this cube may be designed for internal access in accordance with the teachings of the prior U.S. Pat. Nos. 3,703,045 and 3,774,337, whereby the cube may opened and photographs or pictures may be positioned inside. Particularly, as shown in FIG. 1, a bottom member 12 may be slideably mounted on edges 13 to allow access to the internal portions of the structure.

In the preferred embodiment there is provided a sheet 14 affixed or held to said side wall by an internal support 15 and bearing a pictorial description of a person or service such as a doctor, fire department, or ambulance. In the preferred embodiment, internal of said side walls there is provided means 16 for mounting the phone number display related to said person or service. This means for mounting the phone number for display may comprise pressure sensitive adhesive means or a window pocket arranged to apply said number to said internal support to the picture themselve or to said walls to allow visibility through the walls of said structure. This nonpermanent mounting of the number promotes updating or changing of the numer displayed. The mounting means for displaying the number may also include any other equivalent method which will accomplish the objectives of the invention, and specifically including means for interposing and securing said phone number display between said sheet and said side wall for visibility through the side wall.

Figure 2:
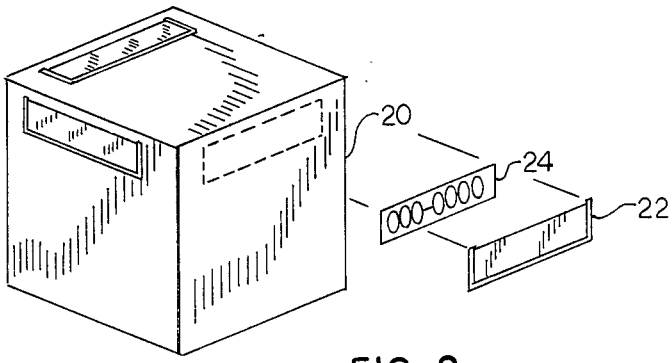
FIG. 2 is a pictorial view of an alternative embodiment of the present invention showing a cube having means for mounting the phone number display arranged on the exterior of the cube.
Figure 3:
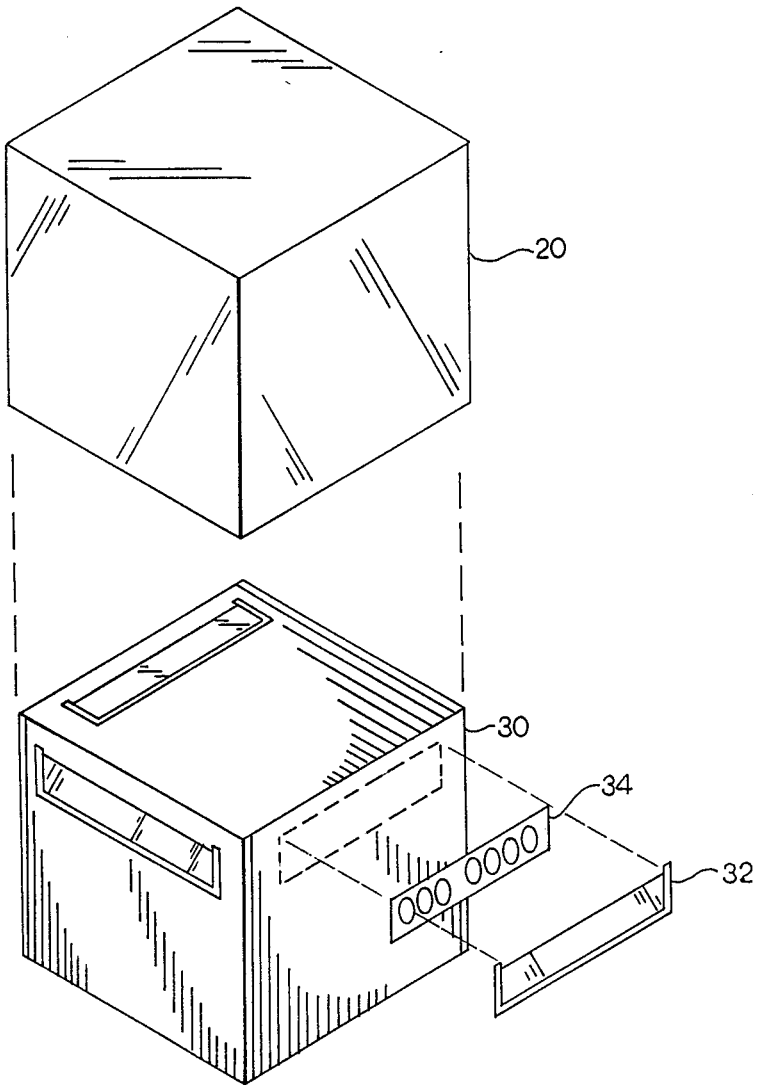
FIG. 3 is a pictorial view of a alternative embodiment of the present invention showing a cube having means for mounting the phone number display arranged on the internal support member.

In yet a further embodiment as shown in FIG. 2, there is provided a multi-sided structure or cube of clear plastic side walls 20 having sheets of pictorial information displayed therethrough as described with respect to FIG. 1. On the outer surface of said wall there is provided a transparent sleeve 22 affixed to the side wall and arranged to accept a phone number display 24. In this embodiment a strip of material bearing the required phone number would be inserted within the transparent sleeve and retained therein by friction for perminent display in association with the appropriate picture. This mounting on the exterior may also be accomplished by pressure sensitive adhesive means, but preferably incorporates a surface shield, clear window or similar means to protect the displayed number. As shown in FIG. 3, the pocket may be disposed on the internal structure 30. The sleeves 32 are affixed to the sides of the structure and arranged to accept the phone number bearing members 34.

From the foregoing description, it will be apparent that modifications can be made to the apparatus and method for using same without departing from the teaching of the present invention. Accordingly the scope of the invention is only to be limited as necessitated by the accompanying claims.

I claim:

1. A phone number display device for displaying phone number bearing members in conjunction with pictures comprising:

a multi-sided structure of transparent walls;

an internal support member arranged to hold the pictures against said walls; and pocket disposed on said walls for receiving said phone numbers bearing members.

2. The phone number display device of claim 1 wherein said multi-sided structure comprises five walls permanently affixed one to the other to form a solid structure, and having a sixth side arranged to be slideably removable from said structure.

3. A phone number display device for displaying phone number bearing members in conjunction with picture comprising:

a multi-sided structure of transparent walls;

an internal support member arranged to hold the pictures against said walls; and pockets disposed on said internal support member for receiving said phone number bearing members.

4. The phone number display device of claim 3 wherein said multi-sided structure comprises five walls permanently affixed one to the other to form a solid structure, and having a sixth side arranged to be slideably removeable from said structure.

* * * * *